United States Patent [19]

Zeigler

[11] 3,968,808

[45] July 13, 1976

[54] COLLAPSIBLE SELF-SUPPORTING STRUCTURE

[76] Inventor: Theodore R. Zeigler, 2007 R St., NW., Washington, D.C. 20009

[22] Filed: Nov. 6, 1974

[21] Appl. No.: 521,472

[52] U.S. Cl. ..... 135/4 R; 135/DIG. 3; 52/81; 52/109; 52/646

[51] Int. Cl.[2] ..... A45F 1/16; E04H 12/18

[58] Field of Search ..... 135/1 R, 3 R, 3 E, 4 R, 135/DIG. 3; 52/80, 81, 109, 641, 646

[56] References Cited

UNITED STATES PATENTS

| | | | |
|---|---|---|---|
| 2,711,181 | 6/1955 | Woods | 135/4 R |
| 3,059,658 | 10/1962 | Finlayson | 135/4 R |
| 3,496,686 | 2/1970 | Bird | 135/1 R |
| 3,710,806 | 1/1973 | Kelly et al. | 135/4 R |
| 3,766,932 | 10/1973 | Sidis et al. | 52/646 |

*Primary Examiner*—Werner H. Schroeder
*Assistant Examiner*—Conrad L. Berman
*Attorney, Agent, or Firm*—Snyder, Brown and Ramik

[57] ABSTRACT

A collapsible, self-supporting structure is disclosed wherein the structure is made up of a network of rod elements pivotally joined at their ends and forming scissors-like pairs in which rod element crossing points are pivotally joined. The network consists of a plurality of pairs of inner and outer apical points where groups of radiating rods are pivotally joined. The outer apical points lie on a surface of revolution such as a spherical section and each group of rods radiating from an inner apical point lie essentially in a common plane whereby to effect the self-supporting action. For any pair of apical points the group of rods defining the inner apical point radiate in their common plane and join rods of other groups at the surrounding outer apical points.

28 Claims, 27 Drawing Figures

FIG. 15
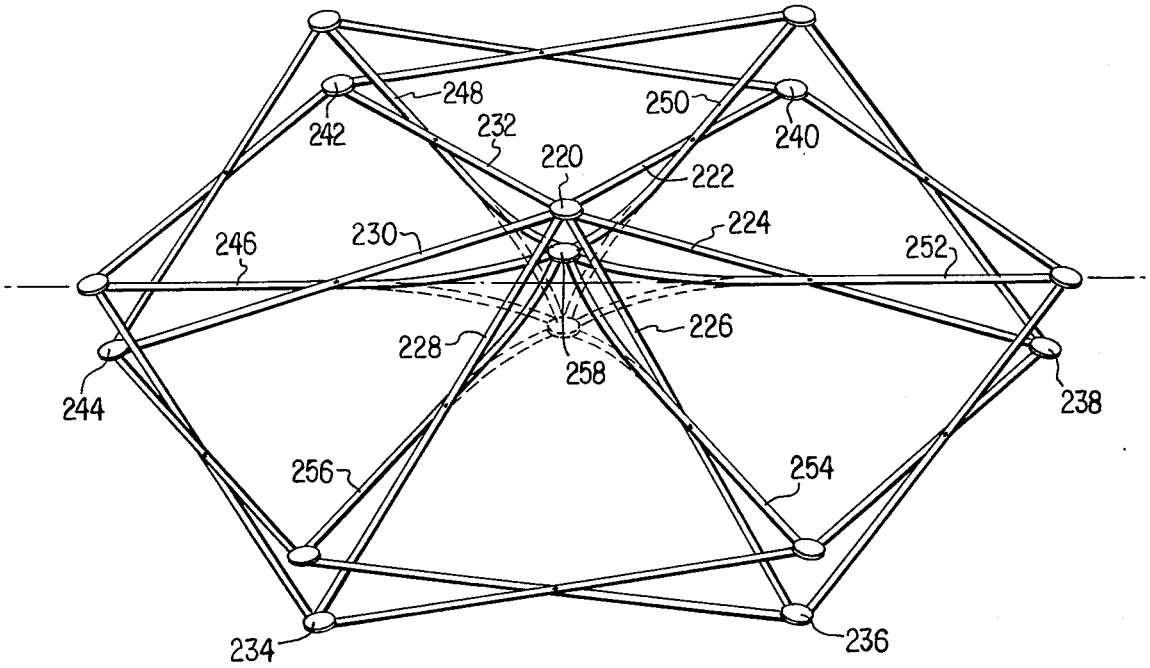
FIG. 18
FIG. 17
FIG. 16
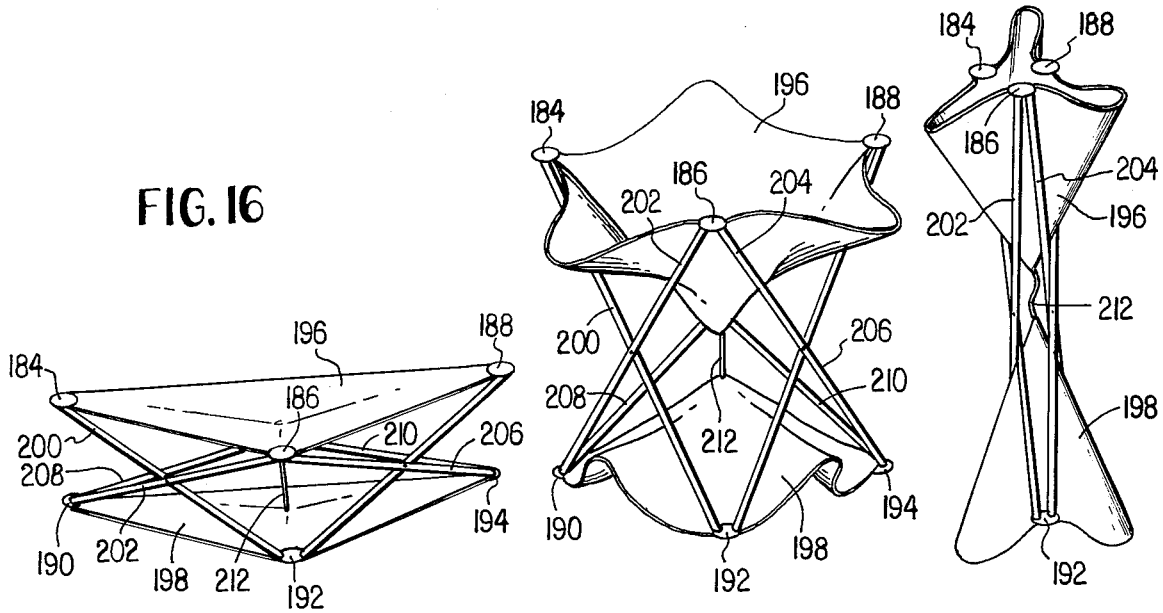

FIG. 19
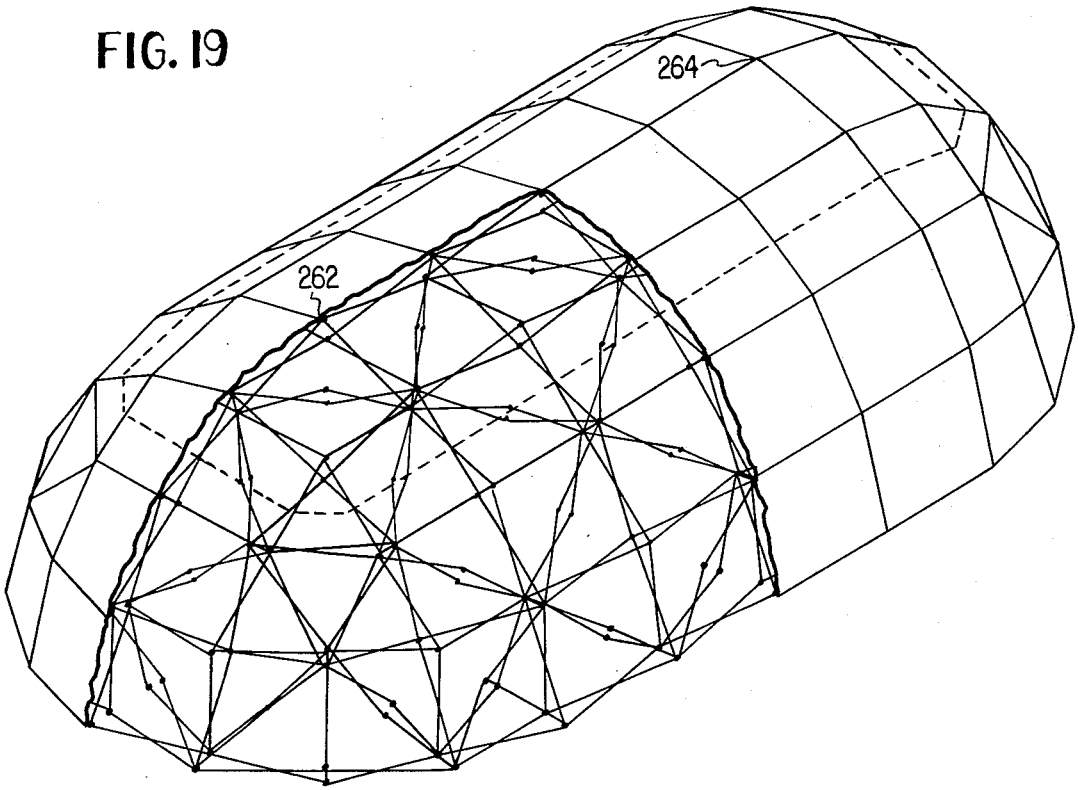
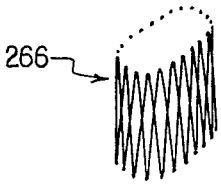
FIG. 20
FIG. 22
FIG. 21
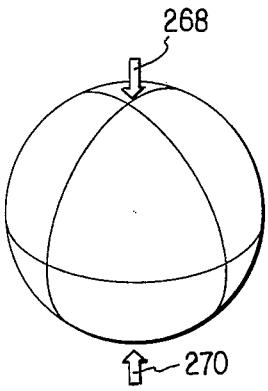
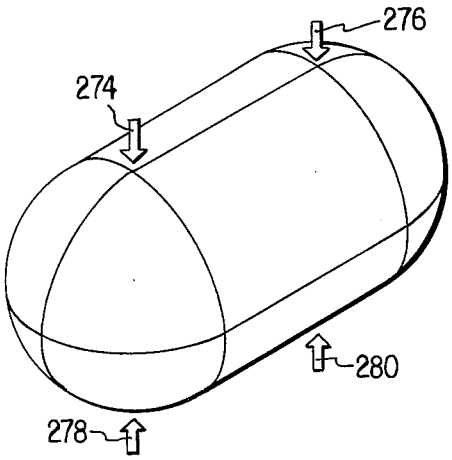
FIG. 23
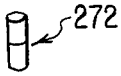
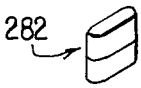
FIG. 24

FIG. 25
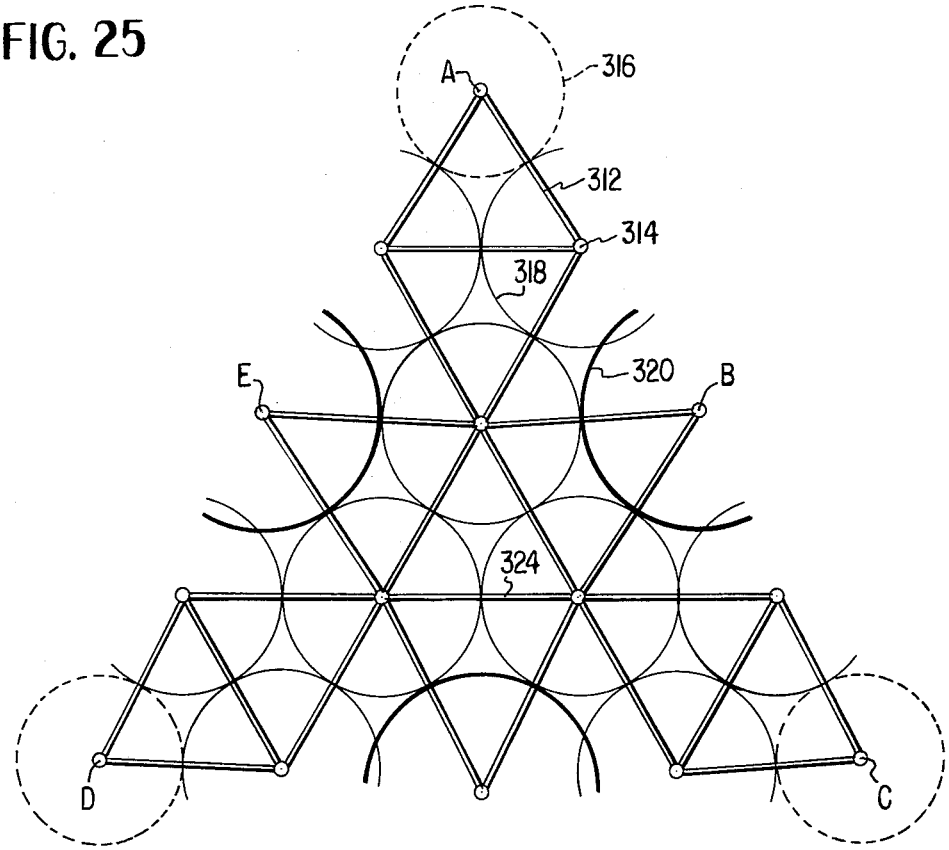
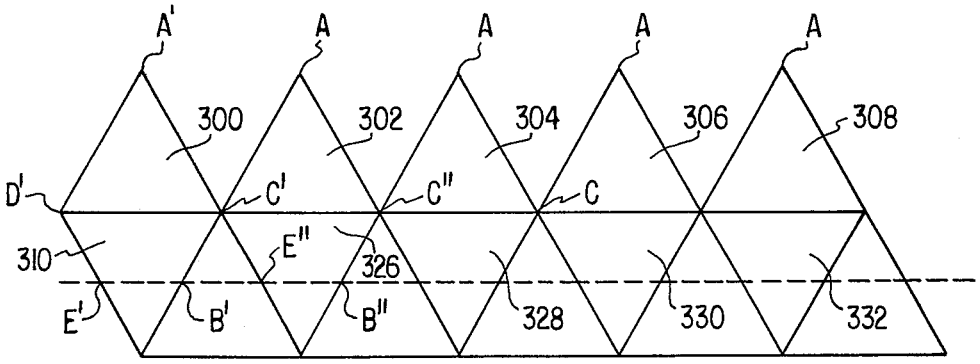
FIG. 26

COLLAPSIBLE SELF-SUPPORTING STRUCTURE

BACKGROUND OF THE INVENTION

Various building or similar structures have been proposed which are based upon column-like elements or rods used as basic construction units which function as stays. A fabric covering is usually associated with the network of rods employed. Also, it is usual for such assemblies to have foldable/extensible capability so that they may be extended/erected where desired and, when necessary, folded up to a rather compact form for storage and/or transportation. Other structures of this general nature are intended to remain in place once erected and within this category are what is known as geodesic structures.

Generally speaking, where the structures are intended to remain in place once erected, the rods or column-like element are rigidly joined together, whereas for the extensible/foldable structures these rods ordinarily are joined pivotally. Examples of extensible/foldable structures are found in the Pinero Pat. No. 3,185,164, the Greenberg et al Pat. No. 3,496,687 and the Kelley et al Pat. No. 3,710,806.

The patents are exemplary of the fact that the prior art in order to achieve an extensible/foldable capability has found it necessary to resort to various types of extraneous locking means. For example, in the Pinero patent not only is a system of cables *a,b* necessary to form the extended shape of the structure, but cables *c* are also required to hold such shape (i.e., to render the structure self-supporting). The Kelley et al patent represents another basic approach and that is to provide hub-connected scissors linkages.

In all of the prior art devices, except in those instances where positive locking means are used, the structural integrity of the extended, erected structure is not great and none employs an arrangement wherein structural integrity results from a relationship among the rod-like elements which is attained by and incidental to the erected shape itself and which does not rely upon physical constraint of the pivotal connections among the rod elements.

BRIEF SUMMARY OF THE INVENTION

The present invention is directed to a framework arrangement which is self-supporting when erected while being at the same time characterized by the fact that free pivotal connections among the column-like elements is possible. That is to say, the arrangement herein derives self support by virtue of and in natural consequence to the shape which is assumed when extended into fully extended form. A fabric covering may be employed but the self-supporting relation does not rely upon such covering. The rod-like elements may remain freely pivotally interconnected at all times and whereas the extended structure may be rigidified by extraneous means, it does not rely thereon for the basic self-supporting relation naturally attained.

Basically, the present invention employs a network of pivotally joined elements in which coordinated groups thereof are pivotally joined at corresponding ends thereof, the groups being paired such that the elements of one group of each pair intersects to define an inner apical point whereas the elements of the other group of the pair intersect to form an outer apical point. The outer of these pairs of apical points are distributed over and within a surface of revolution such as a semi-sphere with elements of adjacent groups being joined such that any pair thereof extending from one outer apical point to an adjacent outer apical point having a further outer apical point intervening (the element-pair in the process intersecting at an inner apical point corresponding to the intervening outer apical point) lie in a straight line. Other element-pairs intersecting at the inner apical point corresponding to the intervening outer apical point lie in a common plane containing the first-mentioned element-pair. This is a basic characteristic of the present invention.

A further basic feature of the present invention resides in the fact that further element-pairs are crossed and pivotally joined between their ends and are end-connected pivotally to other such crossed pairs. In any structure of this invention these will be strings of such crossed pairs of elements (i.e., a "ladder" thereof) extending arch-like within the structural shape, in which certain ones of the pivotal connections between crossed elements are omitted. This feature allows a full extension/folding capability without sacrificing the natural self-supporting feature. Moreover, this relationship results in a "programmed" extension or folding of the framework such that a simple, fixed procedure may be followed either to extend or to collapse the framework.

BRIEF DESCRIPTION OF THE DRAWING FIGURES

FIG. 15 is a perspective view of a modification of the invention which may be used to obtain increased strength where desired;

FIGS. 16–18 illustrate a modification employing inner and outer cover material;

FIGS. 19 and 20 illustrate another form of the invention;

FIGS. 21 and 22 illustrate two forms of the invention where the surface of revolution is carried out over 360°;

FIGS. 23 and 24 show the folded configuration of FIGS. 21 and 22 respectively;

FIGS. 25 and 26 are diagrammatic views illustrating certain principles in connection with FIG. 1.

DETAILED DESCRIPTION

Figure 1:
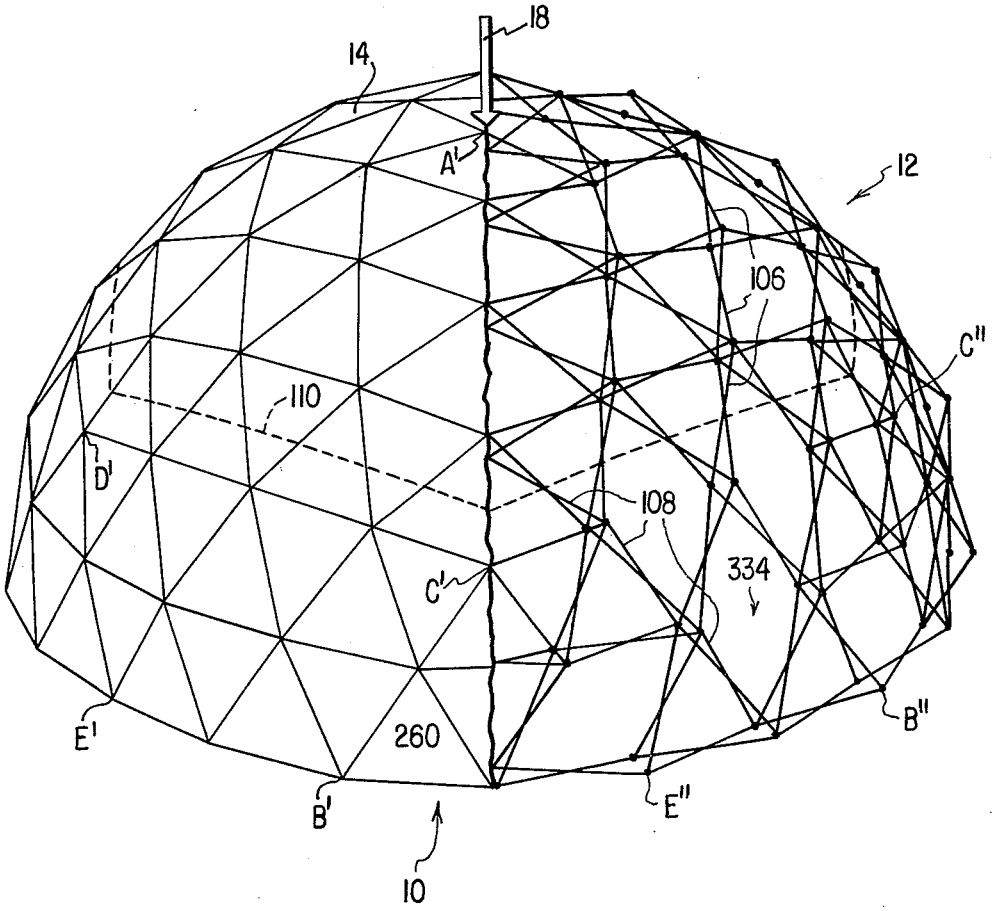
FIG. 1 is a perspective view, partially broken away, showing one form of the invention.

Referring to FIG. 1, the self-supporting structure is indicated generally by reference character 10 and includes a network of column-like elements defining the framework 12 which may be provided with a fabric or other suitable covering 14, half of which has been removed in FIG. 1 to expose the underlying framework.

Figure 2:
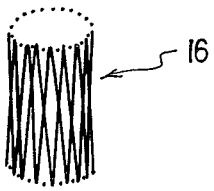
FIG. 2 is a perspective view of the assembly of FIG. 1 in folding condition.

As will appear more clearly as this description proceeds, the structure shown in FIG. 1 may be collapsed or folded down to the compact bundle 16 as illustrated in FIG. 2.

Figure 3:
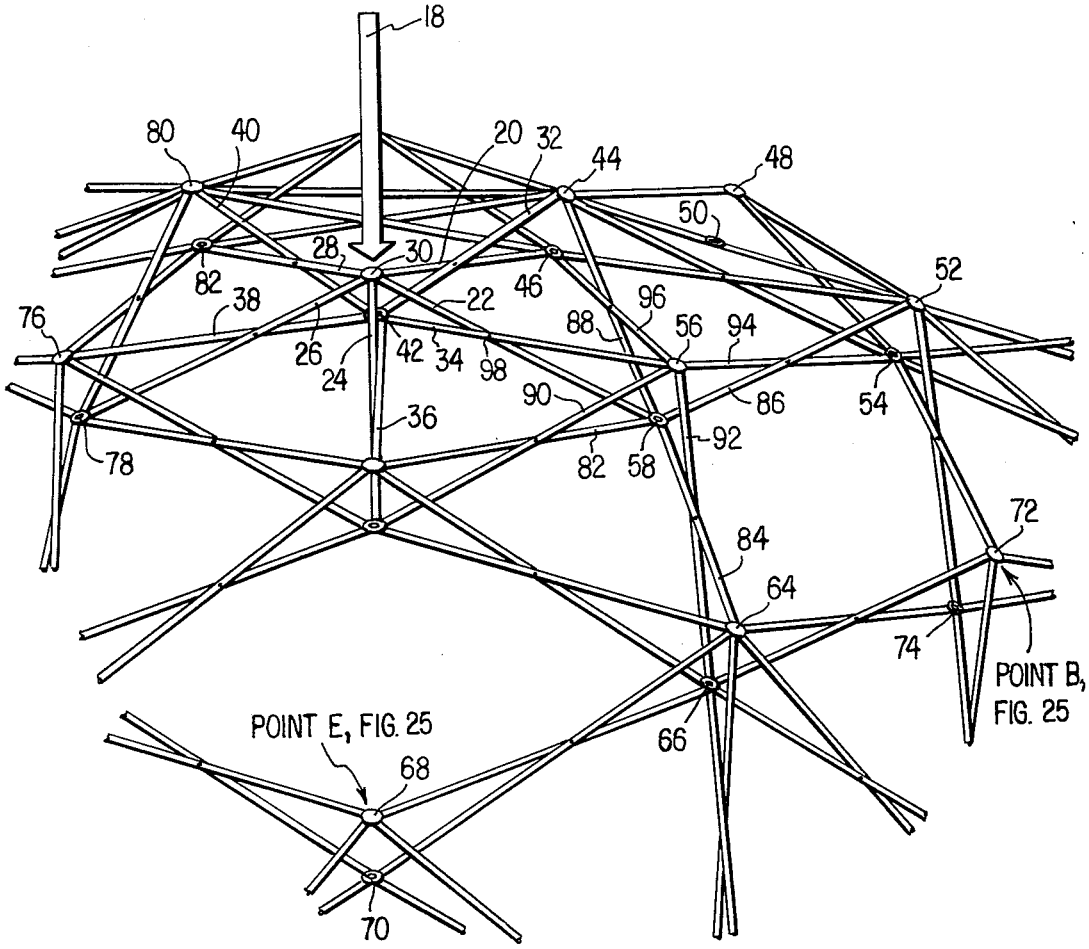
FIG. 3 is a perspective view showing a portion of the framework of FIG. 1.

Structures according to this invention are characterized by the fact that they define generally a surface of revolution, the form shown in FIG. 1 being semi-spherical with the pole thereof indicated by the broad arrow 18. With this pole as a reference, certain basic relations of the invention will appear more clearly from FIG. 3. In this form of the invention, two groups of elements intersect at the pole, one group consisting of the elements 20, 22, 24, 26 and 28 which intersect and are freely pivotally joined at the outer apical point 30, and the other group consisting of the elements 32, 34, 36, 38 and 40 which intersect and are freely pivotally joined at the inner apical point 42. The outer and inner apical points 30 and 42 define a corresponding pair thereof and other corresponding pairs of outer and inner apical points are indicated at 44, 46; 48, 50; 52, 54; 56, 58; 60, 62; 64, 66; 68, 70; 72, 74; 76, 78; and 80, 82. It is a feature of this invention that the outer apical points lie on the aforesaid surface of revolution and that each corresponding pair of outer and inner apical points lie in alignment along a line normal to such surface of revolution, i.e., the pair 30,42 lies in alignment along the pole 18.

Another feature of this invention is that the network of elements is such that the individual elements of the aforesaid groups thereof radiate from their corresponding apical points to join pivotally with other elements at other apical points. Thus, the element 22 for example radiates from its outer apical point 30 to join pivotally with the elements 82, 84, 86 and 88 at the inner apical point 58. Similarly, the element 34 for example radiates from the inner apical point 42 to join pivotally with the elements 90, 92, 94 and 96 at the outer apical point 56. The outer apical points are distributed regularly over the surface of revolution and between each adjacent set of outer and inner apical point pairs a crossed pair of elements extends. For example, the crossed pair formed by the elements 22, 34 extends from the apical point pair 30, 42 to the apical point pair 56, 58 thus forming an adjacent set. At least for the most part, as set forth hereinafter, these crossed pairs are pivotally joined intermediate their ends, i.e., where they cross, the crossed pair 22, 34 for example being pivotally joined in scissors-like fashion by the pin 98.

It is further characteristic of this invention that each group of elements associated with and radiating from each inner apical point and extending therefrom to adjacent outer apical points lies in a common plane. Thus, the group of elements defined by the individual elements 22, 82, 84, 86 and 88, for example, which "belong" to the inner apical point 58 lie in a common plane and extend to the adjacent outer apical points 30, 44, 52, 56 and 60. This basic relationship repeats throughout the network and serves to define the relationship among locations of all the apical points and lengths of the elements. In this connection, it is possible to have all elements of the same length and for at least the majority of elements employed this is a desideratum. However, in the specific form shown in FIG. 1, the elements closest to the pole 18 are of lesser length, as will appear hereinafter.

Figure 4:
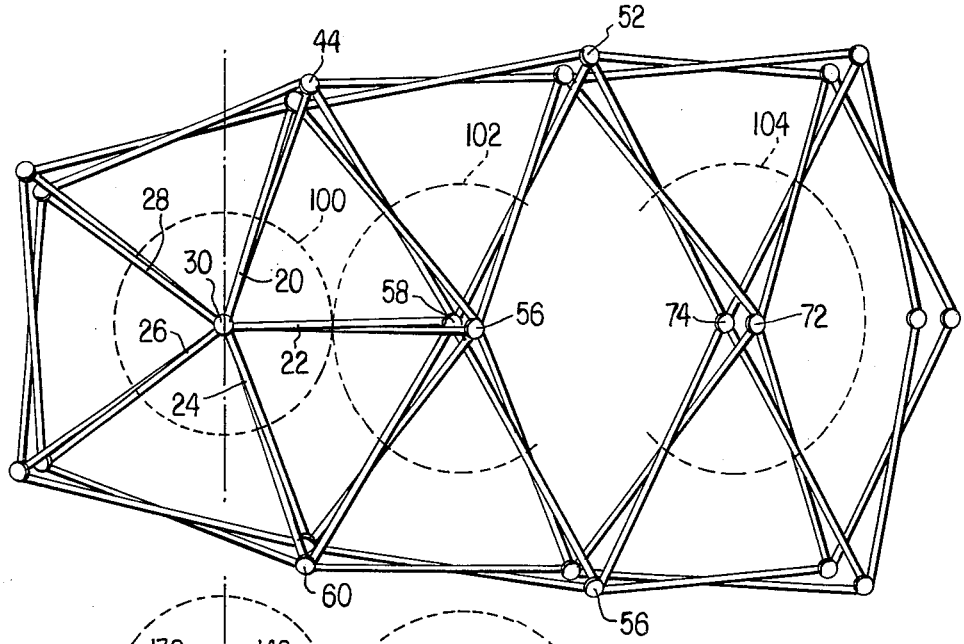
FIG. 4 is a plan view of a portion of the framework.

When the combination of short and long elements is used, as in FIG. 1, the relationship which must prevail is shown in FIG. 4. As shown, the imaginary circles 100, 102, 104, etc. centered upon the axes of the apical point pairs must mutually touch at the crossing points of the element which, in turn, defines the lengths of the elements. Thus, in FIG. 1 there are three element lengths involved, the shortest being those radiating from the apical point pair 30, 42; an intermediate length associated with circles 102 grouped around the pole 18; and the standard length associated with all the remaining circles 104.

By following the relationship above noted, the network will include a number of scissors-like chains or ladders in which a series of crossed pairs of elements extend arch-like within the network, which ladders encompass at least substantially all of the elements in the network. To exemplify this, in the form shown in FIG. 1, some of the legs 106 and 108 of two routes followed by the aforesaid arch-like ladders are shown, it being appreciated that other ladders or routes parallel to these are present in the network.

In each of these ladders, pairs of end joined rods lie essentially in axial alignment, i.e., along a straight line where the structure is erected and the joining points of these element pairs define the inner apical points, the other elements joining at such inner apical points lying essentially in a common plane whereby each group of elements radiating from an inner apical point extending to those outer apical points which lie in surrounding relation to the outer apical point associated with such inner apical point.

Figure 5:
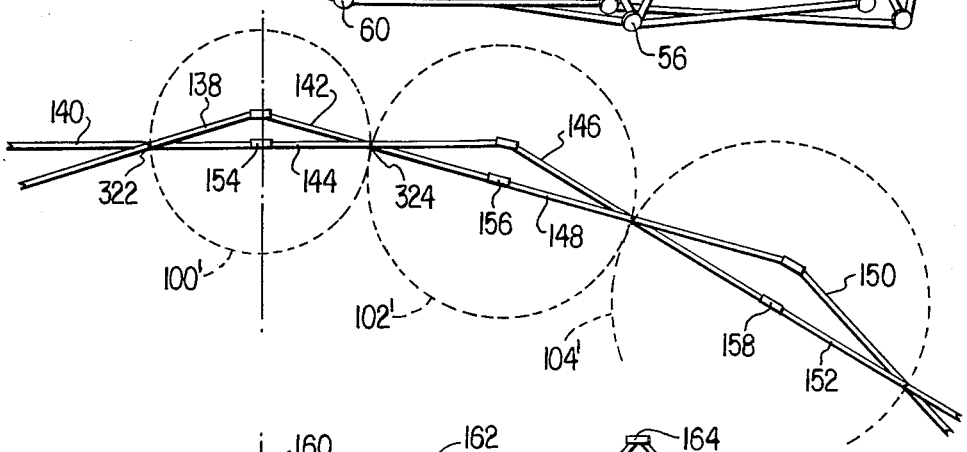
FIG. 5 is an elevation showing a portion of one ladder string.
Figure 6:
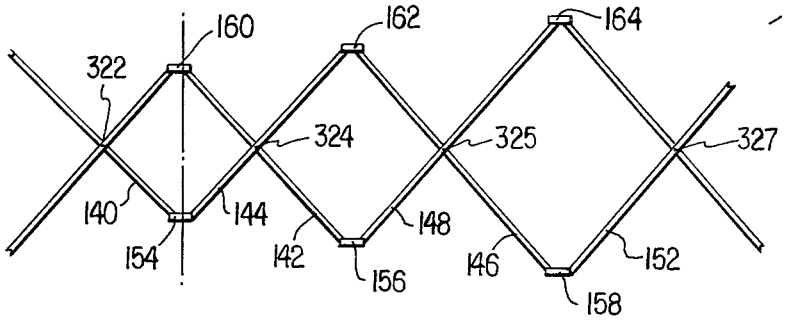
FIG. 6 is a view of the ladder string of FIG. 5 as it is being folded.
Figure 7:
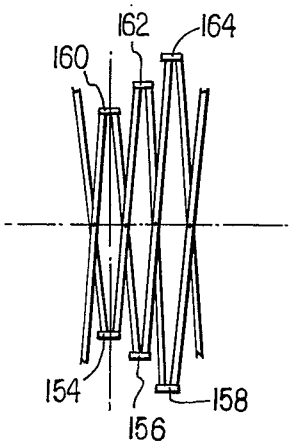
FIG. 7 is a view showing the ladder string in folded condition.

To illustrate a ladder structure and the manner in which it contributes to the self-supporting feature while also participating in the folding action, reference is had to FIGS. 5–7 which related to an embodiment employing the principles of FIG. 27, hereinafter described. In these Figures, the network of elements is somewhat different from that shown in FIG. 1 in that all of the ladders passes through a pole of the structure. Only that portion of the chain or ladder is shown which consists of the crossed pairs of elements 138, 140; 142, 146, 148; and 150, 152. The elements 140 and 144 form two elements of a group radiating essentially in a common plane from the inner apical point 154, likewise for the two elements 142 and 148 associated with the inner apical point 156, likewise for the two elements 146 and 152 associated with the inner apical point 158, and so on for all of the inner apical points associated with the scissors chain. All of the crossed pairs of elements shown in FIGS. 5–7 are pivotally joined at their crossing points but in order to be collapsed, each ladder must have two of such crossing points free to slide, the sliding points being located equidistantly from the central point of the ladder. FIGS. 5–7 also illustrate three basic lengths of elements and associated circles 100', 102' and 104 similar to FIG. 4.

With the sliding points as described, a downward pull on the central inner apical point 154 causes all of the inner apical points 154, 156 and 158 to retreat downwardly while their corresponding outer apical points 160, 162 and 164 rise outwardly as shown in FIG. 6.

That is, the element pairs 140, 144; 142, 148; and 146, 152 begin to vee downwardly out of their aligned or straight line condition. FIG. 7 illustrates the ladder in its fully collapsed or folded condition with all of the outer apical points retreating toward the central outer apical point 160 and all of the inner apical points likewise retreated toward the central inner apical point 154.

FIGS. 5–7 illustrate a further principle of the invention which is necessary in order to establish the folding relationship at each pair of inner and outer apical points. To illustrate this principle, reference is had to FIG. 6 wherein pivotal points joining crossed pairs of elements are indicated at 322, 324, 325 and 327. In order to achieve the folding relationship, the distance from an outer apical point, say the apical point 160, to a pivoted crossing point 324 plus the distance from the corresponding inner apical point 154 to this same pivoted crossing point 324 must be equal to the distance between 160 and 322 plus the distance between 322 and 154. These relationships must hold for all crossed pairs of elements associated with each pair of inner and outer apical points. This will explain why, for example, the crossed pair of elements must be left out between the apical point pairs 56, 58 and 72, 74 in FIG. 4 if the structure is to fold. In FIG. 4, the two circles 102 and 104 are not tangent, but overlap. Thus it is not possible for the above distance relationships to hold for a crossed pair of elements joining the apical point pairs 56, 58 and 72, 74 because they could not be the same as those distance relationships which prevail for the other crossed pairs shown, i.e., those joining the apical point pairs 56, 58 and any other apical point pair which is not the pair 72, 74.

Figure 8:
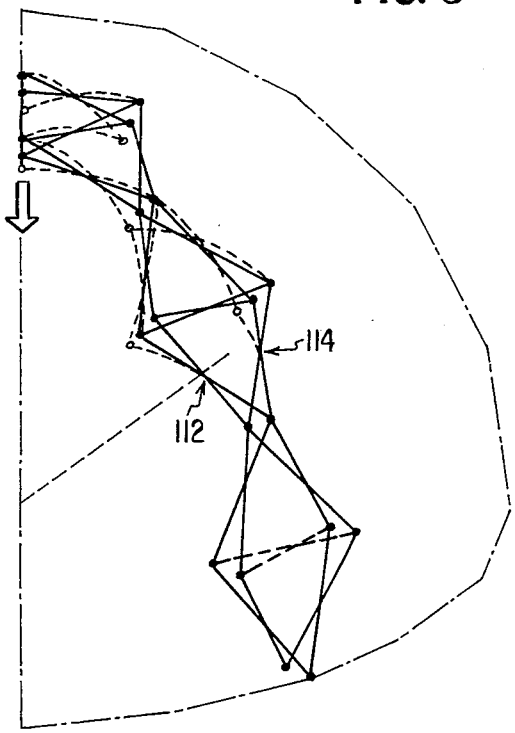
FIG. 8–11 are sequentially folded configurations of a portion of the framework.
Figure 9:
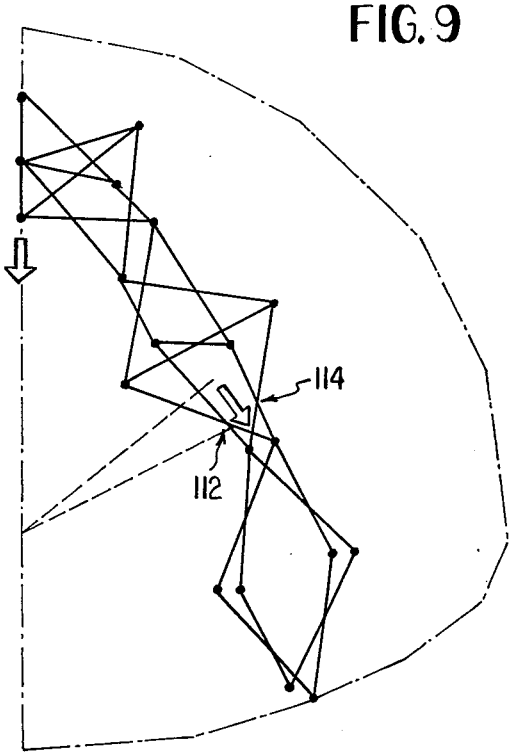
Figure 10:
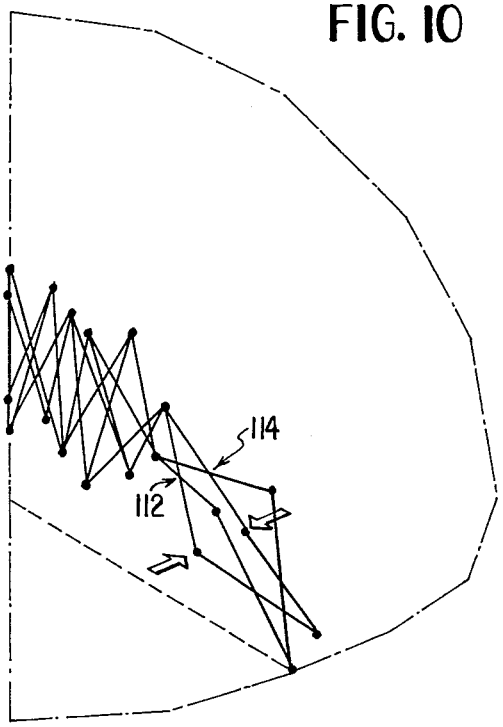
Figure 11:
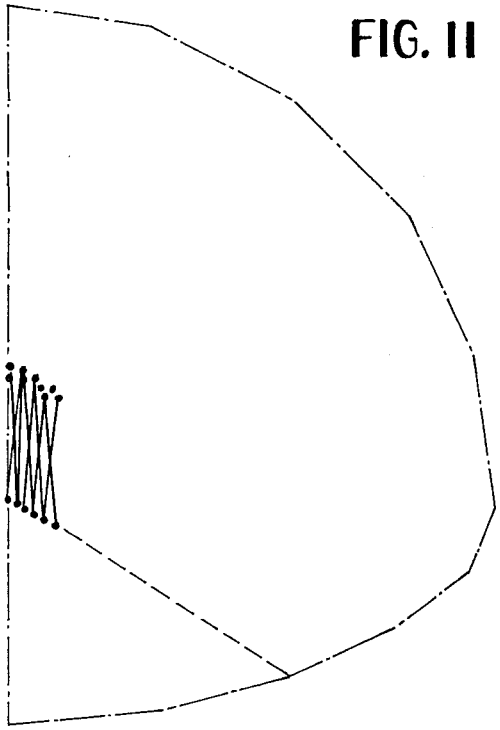

To allow the network to be folded into the compact bundle of FIG. 2, it is necessary that each ladder have two points along its length where the pivot connections of crossed elements is omitted or removed. This relationship, followed throughout the network along a path 110 centered on the pole 18 in FIG. 1, produces a controlled and multi-stage extension/folding of the framework is shown and for all crossed element pairs illustrated except for those at crossing points 112 and 114, pivotal connections are made at the crossing points. By depressing the inner apical point 42 at the central apical point pair 30, 42 the adjoining elements will first flex as indicated by dashed lines in FIG. 8 so as to shorten the effective lengths of these elements and the aforesaid coplanar relationship among elements of the various groups in which the elements are so related, will begin to collapse for it is these coplanar groups which contribute strongly to the self-supporting feature of the framework. Once this begins to occur, as permitted by the relative sliding allowed at the points 112 and 114 as illustrated in FIG. 9, the entire center, inwardly of the points 112 and 114, will collapse downwardly onto the supporting surface as shown in FIG. 10. The omission of the dashed line elements in FIG. 8 allows the structure to move in the directions of the arrows in FIG. 10 as the structure thus collapses and then, by pushing radially inwardly around the base of the structure, all of the crossed elements will close in scissors fashion to "retreat" to the center as shown in FIG. 11, the entire framework undergoing the above throughout so as to create the bundle of FIG. 2.

Figure 12:
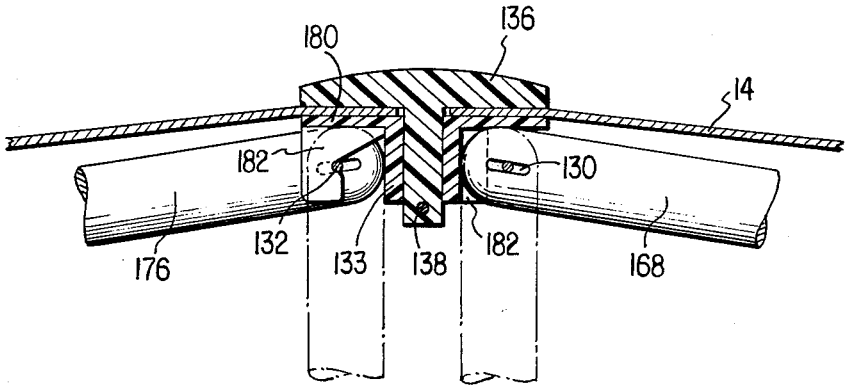
FIG. 12 is an enlarged section showing a universal pivot connection with cover mount.
Figure 13:
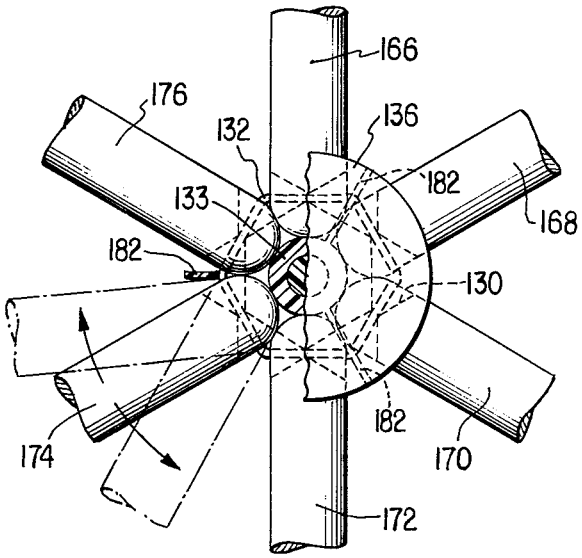
FIG. 13 is a plan view of the connection of FIG. 12.
Figure 14:
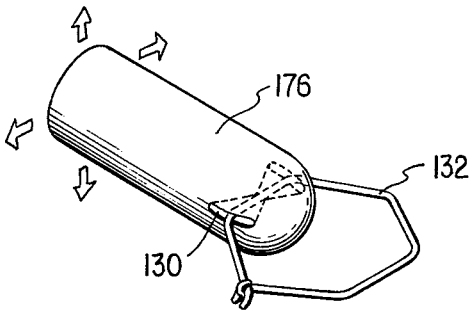
FIG. 14 is a perspective view of one element and the hinge wire.

A preferred universal pivotal connection at the apical points is illustrated in FIGS. 12–14. As shown, each element has a double-ended fan flot 130 through which a wire ring 132 passes so as to allow universal movement of the rod elements. In the embodiment of FIG. 1, there may be as few as three elements intersecting at an apical point and as many as six elements, as shown. The central void in FIGS. 12–14, since this is an outer apical point, is filled by the hub 133 of a flanged sleeve and the step 134 of a button having an enlarged head 136 is projected through the bore of the hub 133. The distal end of the stem 134 is provided with a transverse bore to receive a securing pin 138 or like member, holding same in place.

The hub member 133 is surmounted by a flange 180 and as will be seen in FIG. 12, this flange and the enlarged head 136 sandwich the covering member 14 therebetween plus serving to anchor same in place at the outer apical points. For the inner apical points, the flanged hub member 133 only is utilized. The hub member includes a plurality of radially projecting webs 182 which serve to stabilize the wire ring member 132 and hold all of the rod like elements in proper relationship relative to each other, the inner side of each of the webs 182 being notched as indicated in FIG. 12 to receive the wire ring 132 therewithin to effect the snap action reception of the wire ring within the notches thereby to stabilize the assembly.

As illustrated by the four arrows in FIG. 14, each of the rod elements is capable of universal movement relative to the others by virtue of the double fan opening 130 and at the reception of the wire ring 132 therethrough.

Whereas FIG. 12 illustrates an embodiment wherein an outer covering portion 14 is utilized over the structural framework, the manner in which inner and outer covers may be utilized as illustrated in FIGS. 16–18. In these Figures, three outer apical points 184, 186 and 188 are illustrated and their corresponding inner apical points 190, 192 and 194 with corresponding portions of the inner and outer cover sheets 196 and 198. It will be appreciated that the pattern of elements illustrated in FIGS. 16–18 is repetitively present throughout the structure even though only two elements associated with each apical point are illustrated for the sake of clarity. As illustrated, the pair of rod elements 200, 202 cross and are pivotally joined at their point of crossing, likewise for the pair of elements 204 and 206 and for the pair of rod elements 208 and 210. When the inner apical points 190, 192 and 194 retreat inwardly and the corresponding outer apical points retreat outwardly as is shown in FIG. 17, the corresponding portions of the covers 196 and 198 pluck inwardly in the manner illustrated in FIGS. 17 and 18 by virtue of the flexible inner connecting member 212 which serves to join the geometrical center portion of that section of the covers 196 and 198 within the triangle defined between the corresponding apical points, as is shown.

FIG. 15 illustrates an alternate embodiment of the invention which may be utilized to obtain an increased rigidity and augmented self-supporting function. In FIG. 15, the outer apical point 220 and the group of elements 222, 224, 226, 228, 230 and 232 associated therewith radiate to the surrounding inner apical points 234, 236, 238, 240, 242 and 244 whereas the group of elements 246, 248, 250, 252, 254, and 256 which intersect to form the inner apical point 258 cross and pivotally joined to corresponding elements of the first mentioned group but are slightly longer toward their inner ends than the group of elements associated with the outer apical points 220 so that the inner ends of this group of elements associated with the inner apical point 258 deflect or deform inwardly somewhat as is illustrated in FIG. 15 when urged to such position so as to further rigidify the assembly. Thus, opposed elements such as 256 and 250 are aligned and form essentially a straight line, as before, but their inner ends are slightly deformed out of the common plane otherwise containing the group of elements associated with the inner apical point 258. In order to collapse the assembly, it is necessary to snap the inner apical point 258 inwardly as shown in dotted lines in FIG. 15 and, whereever this configuration is used, the increased rigidity thereof may be very valuable where unusually heavy loads are expected for the assemblage. For example, in FIG. 1, a configuration such as is shown for FIG. 15 may be utilized at desired special points, as for example at the apical point 260 as is illustrated in FIG. 1. On the other hand, a structure such as shown in FIG. 15 may be used by itself or combined with other, similar structures to provide an undulating structure which however lies on a flat surface. In such case, each configuration of FIG. 15 requires separate unlocking to collapse the structure.

FIGS. 19 and 20 illustrate a further embodiment of the invention wherein the outer apical points thereof lie again in a surface of revolution at this time the surface is not spherical except at its end sections, being cylindrical in the intermediate or intervening portion defined between the two apical points 262 and 264 which in fact form the poles of the structure. As will be evident from FIG. 19 and was described hereinbefore, the ladders or chains of scissors-like elements pass directly through the poles at the apical points 262 and 264. Otherwise, the principles previously described are utilized in the configuration of FIG. 19. FIG. 20 indicated generally by the reference character 266 the compact, folded configuration of the collapsed assembly of FIG. 19.

FIGS. 21 and 22 illustrate that the surfaces of revolution may be completed throughout the full 360° of rotation. Thus, in FIG. 21, the spherical shape has two poles 268 and 270 which can collapse inwardly toward each other ultimately to provide the compact folded configuration indicated generally by the reference character 272 in FIG. 23. In FIG. 22, the complete surface of revolution of the embodiment shown in FIG. 19 is illustrated, same having four poles 274, 276, 278 and 280 at which the inward collapsing of the structure is effected ultimately to provide the compact, folded assemblage as is illustrated generally by the reference character 282 in FIG. 24.

Referring more particularly at this time to FIG. 25, certain principles of the construction according to FIG. 1 will be apparent therefrom. The FIG. 1 construction may be further explained in terms of conventional geodesic nomenclature. Specifically, the FIG. 1 embodiment is constructed as a four frequency icosahedron in which one of the triangular regions is illustrated in FIG. 25 and, in FIG. 26, all of the triangular regions are shown but laid out in flat form so as to give a better understanding of the elements involved. In FIG. 25, the various points A, B, C, D and E are depicted and it will be understood that all of the triangular regions 300, 302, 304, 306 and 308 in FIG. 26 are, in FIG. 1, joined at a common point which is represented at the pole 18. To correlate FIGS. 1 and 26, the triangular region 300 has its points designated by prime letters and the triangular region 310 immediately therebelow has its points E′ and D′ designated as shown, thus illustrating that the base of the structure in FIG. 1 is cut off along the dashed line in FIG. 26, the region 310 thus being as shown of truncated triangular form. Specifically, regions such as 310 are cut off at the second division of the side of the triangle shown in FIG. 25 (i.e. at the second of the four frequencies or subdivisions shown).

In FIG. 25, the symbolic representation illustrated at 312, the double line between the points A and 314 is used throughout this Figure to indicate a scissors-connected pair of elements and the dashed circle indicated at 316 symbollically represents the couterpart of the circle 100 in FIG. 4 while the lightweight circles as at 318 correspond to the circle 102 in FIG. 4 while the heavy line circles 320 correspond to the circle 104 in FIG. 4. The significance of these three circles in FIG. 25 is identical to that represented by the circles 100′, 102′ and 104′ in FIG. 5. That is to say, all of the circles in FIG. 25 represent circles whose diameter is equal to the distance between the crossing points 322 and 324 of joined scissors-pairs of elements as is illustrated in FIG. 5. Thus, as is in FIG. 5, the pivotal connection between the elements 142 and 144 lies somewhat closer to the left-hand ends of these elements than it does to the right-hand ends. Similarly for the scissors-pair 146, 148. From FIG. 25 it will be noted that the circle pair 318, 320 overlap as a natural consequence of the icosahedron configuration and whenever this occurs, the crossed pairs of elements are left out between the apical points in question, as was discussed in conjunction with FIG. 6. Thus, in FIG. 25, there are six pairs of crossed elements which are omitted and in this embodiment such is essential in order to have the structure fold. The omitted pairs of crossed elements are clearly evident in FIGS. 1 and 4.

In addition, there are five other pairs of crossed elements which are omitted from the embodiment of FIG. 1 and each of these occurs for the truncated triangular regions designated by the reference characters 310, 326, 328, 330 and 332 as shown in FIG. 6. The region of the omission of this pair from the region 326 is illustrated generally by the reference character 334 in FIG. 1 and it will be seen from FIG. 6, that this omitted pair in each instance corresponds to the crossed pair location indicated at 324 in FIG. 25. The reason for the omission of these five crossed pairs is that, girthwise of the structure, there would otherwise be provided a continuous chain or ladder of crossed element pairs and the structure would not fold without the omission noted. The single exception for this is the continuous chain of crossed element pairs which is at the base of the structure as will be clearly evident from FIG. 1 which, it has been found, can be left intact without detracting from the folding or collapsing feature.

Figure 27:
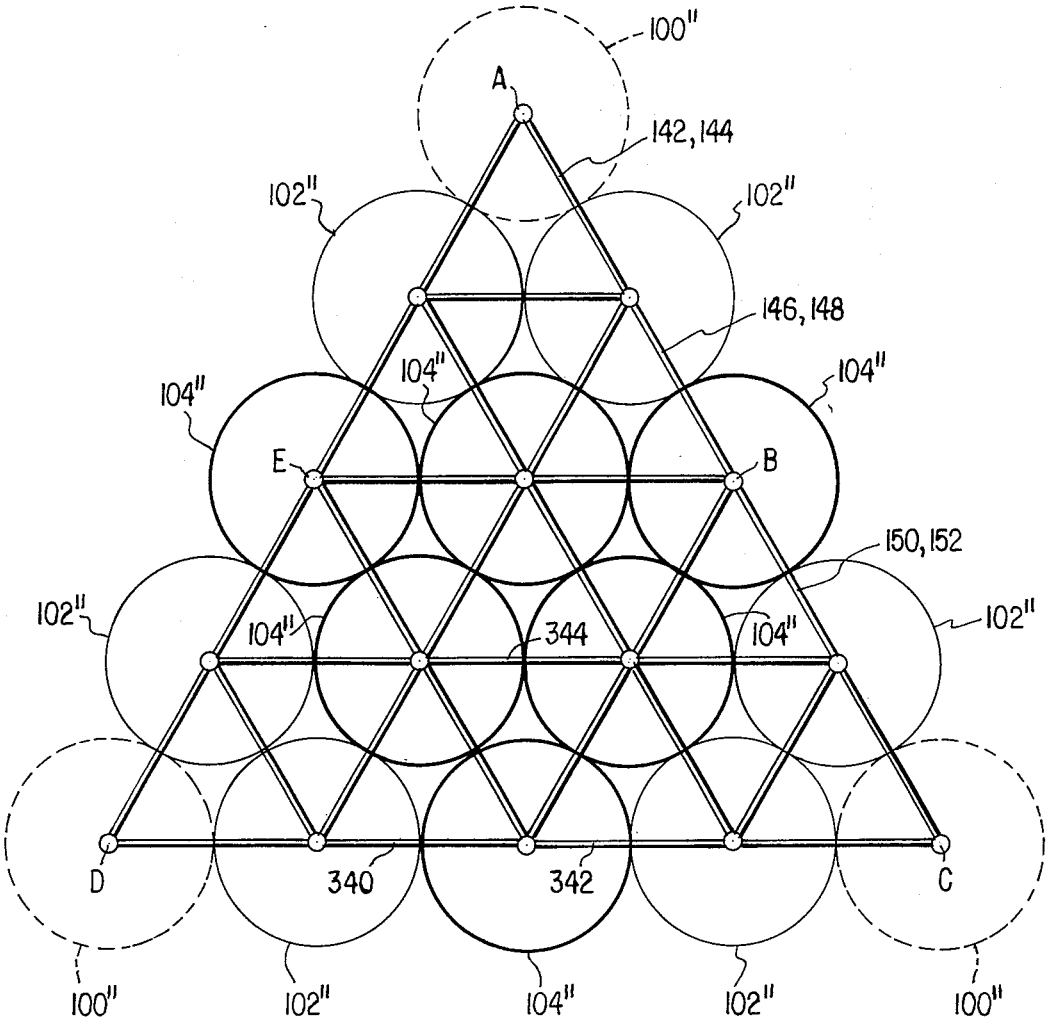
FIG. 27 illustrates a further embodiment of the invention.

An embodiment of the invention which employs a greater number of rod elements is illustrated in FIG. 27, which corresponds to the layout of FIG. 25. In embodiments employing the basic arrangement of FIG. 27, it will be noted that there are six of the largest circles 104″, six of the intermediate size circles 102″ and three of the smallest circles 102″, all of which are tangent as shown and which allows, for those triangular regions of the icosahedron joining at the pole, the use of all of the pairs of crossed rod elements as shown in FIG. 27. To correlate FIGS. 5 and 27, the element pairs shown in FIG. 5 extending from the pole are identified in FIG. 27 at their corresponding diagrmmatically illustrated regions. For the truncated triangular regions (i.e., FIG. 26) either the two pairs of crossed elements 340 and 342 or the crossed pair 344 are left out in order to prevent the occurrence of an uninterrupted girthwise extending chain of cross elements as described above.

What is claimed is:

1. A self-supporting structure, comprising in combination:

a network of column-like elements freely pivotally joined together to form the self-supporting structure, there being groups of said elements which intersect and are freely pivotally joined at their ends to define inner and outer apical points, said outer apical points lying on a surface of revolution and said inner apical points being paired each with a corresponding outer apical point and being spaced inwardly from their corresponding outer apical points along radial lines normal to said surface of revolution;

there being at least three elements forming each of said groups which elements radiate from their corresponding apical points to join with other elements at other surrounding apical points, with those elements radiating from each inner apical point lying essentially in a common plane and radiating from such inner apical point to a plurality of surrounding outer apical points, whereby the network is characterized by a series of planes essentially within which lie elements radiating from and between a number of outer apical points;

each pair of corresponding inner and outer apical points, having a plurality of pairs of elements which radiate therefrom and cross in scissors-like fashion; and means joining said pairs of elements at their crossing points so as to cause the network to be self-supporting.

2. A self-supporting structure as defined in claim 1 wherein the means last mentioned comprise mechanisms pivotally joining said pairs of elements whereby the structure may be collapsed from its self-supporting relation into a compact, folded condition.

3. A self-supporting structure as defined in claim 2 wherein all of those pairs of crossed elements whose crossing points lie along at least one closed girthwise path are free to slide relative to each other.

4. A self-supporting structure as defined in claim 1 wherein said surface of revolution is of spherical section.

5. A self-supporting structure as defined in claim 1 wherein said surface of revolution has a central portion of cylindrical section and end portions of spherical section.

6. A self-supporting structure as defined in claim 1 including a flexible covering secured to outer apical points of said structure.

7. A self-supporting structure as defined in claim 6 wherein the means last mentioned comprise mechanisms pivotally joining said pairs of elements whereby the structure may be collapsed from its self-supporting relation into a compact, folded condition.

8. A self-supporting structure as defined in claim 7 wherein all of those pairs of crossed elements whose crossing points lie along at least one closed girthwise path are free to slide relative to each other.

9. A self-supporting structure as defined in claim 6 wherein said surface of revolution is of spherical section.

10. A self-supporting structure as defined in claim 6 wherein said surface of revolution has a central portion of cylindrical section and end portions of spherical section.

11. A self-supporting structure as defined in claim 1 wherein all elements which are joined at each pair of inner and outer apical points define crossing points such that for each crossed pair of elements the distance from the outer apical point to the crossing point plus the distance from the crossing point to the inner apical point is a constant whereby the structure may be folded into collapsed form.

12. A self-supporting structure as defined in claim 11 wherein at least a majority of said crossed pairs of elements are pivotally joined at their crossing points.

13. A self-supporting structure as defined in claim 12 wherein all of those pairs of crossed elements whose crossing points lie along at least one closed girthwise path are free to slide relative to each other.

14. A self-supporting structure as defined in claim 13 wherein said surface of revolution is of spherical section.

15. A self-supporting structure as defined in claim 13 wherein said surface of revolution has a central portion of cylindrical section and end portions of spherical section.

16. A self-supporting structure as defined in claim 13 including a flexible covering secured to outer apical points of said structure.

17. A self-supporting structure as defined in claim 11 wherein all of those pairs of crossed elements whose crossing points lie along at least one closed girthwise path are free to slide relative to each other.

18. A self-supporting structure as defined in claim 17 wherein said surface of revolution is of spherical section.

19. A self-supporting structure as defined in claim 17 wherein said surface of revolution has a central portion of cylindrical section and end portions of spherical section.

20. A self-supporting structure as defined in claim 19 including a flexible covering secured to outer apical points of said structure.

21. In a self-supporting structure comprising, in combination:

at least three pairs of crossed, rod-like elements radiating from a common center and defining inner and outer apical points at said common center;

means pivotally joining said elements defining each apical point; and a plurality of further pairs of crossed, pivotally joined elements pivotally joining and bridging between the free ends of the pairs of elements first mentioned, the elements of said first mentioned pairs which radiate from said inner apical point lying essentially in a common plane.

22. In a self-supporting structure as defined in claim 21 wherein said elements which lie essentially in a common plane cross and are pivotally joined to the elements radiating from the outer apical point at points such that the distance from the outer apical point to the pivotal joining means of said inner and outer elements is less than the distance from the inner apical point to said pivotal joining means wherein said apical point is flexed toward said outer apical point to lock the structure.

23. A self-supporting structure as defined in claim 1 including an inner, flexible skin element secured to said inner apical points.

24. A self-supporting structure as defined in claim 23 including an outer, flexible skin element secured to said outer apical points, and means joining said skin elements outside said apical points.

25. A self-supporting structure which is also capable of being collapsed into compact form, comprising in combination:

a network of column-like elements freely pivotally joined together to form the self-supporting structure;

said elements beng arranged in a plurality of sections which each are of polygonal plan view and said sections being joined together cumulatively to define the surface area of the self-supporting structure;

each section comprising at least three pairs of crossed elements radiating from a common center and defining inner and outer apical points at said common center and at the corners of the plan view polygon defined by each section, the elements of each section whose ends define the inner and outer apical points at said corners of each section being pivotally joined to the ends of elements of adjacent sections and those elements of each section which radiate from an inner apical point lying essentially in a common plane;

means pivotally joining each pair of crossed elements in the majority of said sections whereby the structure is self supporting while certain of the pairs of crossed elements in the remainder of said sections being free to slide relative to each other whereby said structure may be collapsed.

26. A self-supporting structure as defined in claim 25 including an inner, flexible skin element secured to said inner apical points.

27. A self-supporting structure as defined in claim 26 including an outer, flexible skin element secured to said outer apical points, and means joining said skin elements outside said apical points.

28. A self-supporting structure as defined in claim 25 including a flexible covering secured to outer apical points of said structure.

* * * * *

UNITED STATES PATENT AND TRADEMARK OFFICE

CERTIFICATE OF CORRECTION

PATENT NO. : 3,968,808

DATED : July 13, 1976

INVENTOR(S) : Theodore R. Zeigler

It is certified that error appears in the above-identified patent and that said Letters Patent are hereby corrected as shown below:

Column 4, line 47 after "142," insert ---144---.

Column 5, last line, change "flot" to ---slot---.

Column 7, line 36, after "266" insert ---is---.

Column 6, line 7, change "step" to -- stem --.

Column 8, line 67, change "diagrmmatically" to -- diagrammatically --.

Column 11, line 14, change "beng" to -- being --.

Signed and Sealed this

Fourteenth Day of September 1976

[SEAL]

*Attest:*

RUTH C. MASON
*Attesting Officer*

C. MARSHALL DANN
*Commissioner of Patents and Trademarks*